US012213514B2

(12) United States Patent
England et al.

(10) Patent No.: US 12,213,514 B2
(45) Date of Patent: Feb. 4, 2025

(54) ARTICLE FOR USE IN AN APPARATUS FOR HEATING SMOKABLE MATERIAL

(71) Applicant: NICOVENTURES TRADING LIMITED, London (GB)

(72) Inventors: Will England, London (GB); Tom Woodman, London (GB); Jeremy Phillips, London (GB); Pablo Javier Ballesteros Gomez, London (GB)

(73) Assignee: NICOVENTURES TRADING LIMITED, London (GB)

( * ) Notice: Subject to any disclaimer, the term of this patent is extended or adjusted under 35 U.S.C. 154(b) by 627 days.

(21) Appl. No.: 16/302,690

(22) PCT Filed: May 19, 2017

(86) PCT No.: PCT/EP2017/062146
§ 371 (c)(1),
(2) Date: Nov. 19, 2018

(87) PCT Pub. No.: WO2017/198837
PCT Pub. Date: Nov. 23, 2017

(65) Prior Publication Data

US 2019/0116874 A1 Apr. 25, 2019

(30) Foreign Application Priority Data

May 20, 2016 (GB) ..... 1608928

(51) Int. Cl.
*A24D 1/20* (2020.01)
*A24D 3/04* (2006.01)
(Continued)

(52) U.S. Cl.
CPC ..... *A24F 1/12* (2013.01); *A24D 1/20* (2020.01); *A24D 3/043* (2013.01); *A24D 3/10* (2013.01);
(Continued)

(58) Field of Classification Search
CPC ..... A24D 1/004; A24D 1/027; A24D 1/042; A24D 1/045; A24D 1/20; A24D 3/043;
(Continued)

(56) References Cited

U.S. PATENT DOCUMENTS 1,622,334 A 3/1927 Metzger
2,979,058 A 4/1961 Schur
(Continued)

FOREIGN PATENT DOCUMENTS

AT 507187 A4 3/2010
AT 507187 B1 3/2010
(Continued)

OTHER PUBLICATIONS

International Search Report and Written Opinion, Application No. PCT/EP2017/062146, dated Sep. 13, 2017, 16 pages.
(Continued)

*Primary Examiner* — Michael J Felton
(74) *Attorney, Agent, or Firm* — Husch Blackwell

(57) ABSTRACT

A smoking article for use with an apparatus for heating smokable material to volatilize at least one component of the smokable material, the article includes a body of smokable material and a filter assembly. The filter assembly includes a cooling segment of between 20 mm and 30 mm in length for cooling at least one volatilized component of the smokable material, a filter segment adjacent to the cooling segment for filtering at least one volatilized component of the smokable material and a mouth end segment adjacent to the filter segment for being received in a mouth of a user. The cooling segment is located between the body of smokable material and the filter segment.

12 Claims, 5 Drawing Sheets

(51) Int. Cl.
*A24D 3/10* (2006.01)
*A24D 3/17* (2020.01)
*A24F 1/12* (2006.01)
*A24D 1/02* (2006.01)

(52) U.S. Cl.
CPC ..... *A24D 3/17* (2020.01); *A24D 1/027* (2013.01); *A24F 2700/03* (2013.01)

(58) Field of Classification Search
CPC . A24D 3/048; A24D 3/10; A24D 3/17; A24D 3/18; A24D 1/00; A24D 1/02; A24F 2700/03; A24F 1/12
See application file for complete search history.

(56) References Cited

U.S. PATENT DOCUMENTS 3,486,508 A 12/1969 Sipos et al.
4,373,539 A 2/1983 Innacelli
4,582,073 A 4/1986 Simkanich
4,646,762 A 3/1987 Riehl et al.
4,756,318 A 7/1988 Clearman et al.
4,898,191 A 2/1990 Johnson et al.
4,913,169 A 4/1990 Templeton
4,966,171 A 10/1990 Serrano et al.
5,027,836 A 7/1991 Shannon et al.
5,027,839 A 7/1991 Appell
5,115,820 A 5/1992 Hauser et al.
5,144,962 A 9/1992 Counts et al.
5,327,915 A 7/1994 Porenski et al.
5,388,594 A 2/1995 Counts et al.
5,499,636 A * 3/1996 Baggett, Jr. ..... A24C 5/01 131/374
5,611,360 A 3/1997 Tang
5,820,967 A 10/1998 Gadkaree
6,053,176 A 4/2000 Adams et al.
6,089,857 A 7/2000 Matsuura et al.
6,206,007 B1 3/2001 Yoshida et al.
6,568,402 B1 5/2003 Kaneki et al.
6,814,786 B1 11/2004 Zhuang et al.
7,160,366 B2 1/2007 Blackburn et al.
7,243,659 B1 * 7/2007 Lecoultre ..... A24C 5/476 131/331
8,997,753 B2 4/2015 Li et al.
9,259,031 B2 2/2016 Branton et al.
D828,912 S 9/2018 Powell et al.
10,159,284 B2 12/2018 Dickens
10,375,996 B2 8/2019 Aoun et al.
10,420,375 B2 9/2019 England
10,426,199 B2 10/2019 Turner et al.
10,779,577 B2 9/2020 England
2004/0194792 A1 10/2004 Zhuang et al.
2004/0261807 A1 12/2004 Dube et al.
2005/0133051 A1 6/2005 Luan et al.
2005/0133054 A1 6/2005 Fournier et al.
2006/0144412 A1 7/2006 Mishra et al.
2006/0201524 A1 9/2006 Zhang et al.
2007/0023056 A1 2/2007 Cantrell et al.
2007/0215168 A1 9/2007 Banerjee et al.
2007/0235050 A1 * 10/2007 Li ..... A24D 3/045 131/338
2008/0092912 A1 4/2008 Robinson et al.
2008/0110470 A1 5/2008 Zhuang et al.
2008/0216848 A1 9/2008 Li et al.
2010/0108085 A1 5/2010 Duke
2011/0088707 A1 4/2011 Hajaligol
2011/0136815 A1 6/2011 Zerbe et al.
2011/0226236 A1 9/2011 Buchberger
2011/0232657 A1 9/2011 Karles et al.
2011/0271968 A1 11/2011 Carpenter et al.
2012/0017926 A1 1/2012 Karles et al.
2012/0042885 A1 2/2012 Stone et al.
2012/0048286 A1 3/2012 Luan et al.
2012/0318882 A1 12/2012 Abehasera
2013/0104915 A1 * 5/2013 Eitzinger ..... A24D 1/10 131/281
2013/0133675 A1 5/2013 Shinozaki et al.
2013/0192620 A1 8/2013 Tucker et al.
2014/0048085 A1 2/2014 Cox
2014/0076340 A1 3/2014 Kizer et al.
2014/0166029 A1 6/2014 Weigensberg et al.
2014/0261486 A1 9/2014 Potter et al.
2014/0299125 A1 10/2014 Buchberger
2014/0305449 A1 10/2014 Plojoux et al.
2014/0356607 A1 12/2014 Woodcock
2014/0373856 A1 12/2014 Zuber et al.
2015/0027454 A1 1/2015 Li et al.
2015/0027474 A1 1/2015 Zuber et al.
2015/0163859 A1 6/2015 Schneider et al.
2015/0164132 A1 * 6/2015 Eitzinger ..... D21H 17/26 131/336
2015/0196059 A1 7/2015 Liu
2015/0257447 A1 9/2015 Sullivan
2016/0120224 A1 5/2016 Mishra et al.
2016/0174610 A1 6/2016 Kuczaj
2016/0255879 A1 9/2016 Paprocki et al.
2017/0042221 A1 2/2017 England
2017/0143038 A1 5/2017 Dickens
2017/0347706 A1 12/2017 Aoun et al.
2018/0027882 A1 2/2018 Hepworth et al.
2018/0035719 A1 2/2018 Turner et al.
2018/0116275 A1 * 5/2018 Malgat ..... A24F 40/20
2018/0360122 A1 12/2018 Aoun et al.
2019/0216132 A1 7/2019 Phan et al.
2019/0320725 A1 10/2019 England

FOREIGN PATENT DOCUMENTS

CA 885796 A 11/1971
CA 2271432 A1 11/2000
CA 2330782 A1 7/2002
CA 2416144 C 7/2008
CA 2925645 A1 4/2015
CL 199100970 A1 2/1992
CL 2011003332 A1 7/2012
CL 2018003273 A1 3/2019
CN 1054887 A 10/1991
CN 1122213 A 5/1996
CN 1725961 A 1/2006
CN 101433818 A 5/2009
CN 201299093 Y 9/2009
CN 101557728 A 10/2009
CN 101715305 A 5/2010
CN 102834027 A 12/2012
CN 103315402 A 9/2013
CN 103501644 A 1/2014
CN 103892467 A 7/2014
CN 104203015 A 12/2014
CN 204273243 U 4/2015
CN 104780792 A 7/2015
CN 104921296 A 9/2015
CN 104939314 A 9/2015
DE 1056023 B 4/1959
DE 2940535 A1 10/1980
EP 0174645 A2 3/1986
EP 0254551 A1 1/1988
EP 0307118 A1 3/1989
EP 0352106 A2 1/1990
EP 0535695 A2 4/1993
EP 0585016 A1 3/1994
EP 0845220 A1 6/1998
EP 0908110 A1 4/1999
EP 2489391 A1 8/2012
EP 2625974 A1 8/2013
EP 2625975 A1 8/2013
EP 2789248 A1 10/2014
EP 3039972 A1 7/2016
EP 3127443 A1 2/2017
EP 3446574 A1 2/2019
EP 3457875 B1 4/2021
GB 1349537 A 4/1974
GB 2210546 A 6/1989
JP S50132196 A 10/1975

(56) References Cited

FOREIGN PATENT DOCUMENTS

| | | | | |
|---|---|---|---|---|
| JP | H0436731 | A | 2/1992 | |
| JP | H0590161 | U | 12/1993 | |
| JP | H0664983 | A | 3/1994 | |
| JP | H09233999 | A | 9/1997 | |
| JP | H104946 | A | 1/1998 | |
| JP | 2000325067 | A | 11/2000 | |
| JP | 2001120250 | A | 5/2001 | |
| JP | 2005517421 | A | 6/2005 | |
| JP | 2009191148 | A | 8/2009 | |
| JP | 2009531052 | A | 9/2009 | |
| JP | 2010520755 | A | 6/2010 | |
| JP | 2011205917 | A | 10/2011 | |
| JP | 2012506263 | A | 3/2012 | |
| JP | 5068817 | B2 | 11/2012 | |
| JP | 2013523087 | A | 6/2013 | |
| JP | 2013539659 | A | 10/2013 | |
| JP | 2014511675 | A | 5/2014 | |
| JP | 2014525237 | A | 9/2014 | |
| JP | 2014529996 | A | 11/2014 | |
| JP | 2014532435 | A | 12/2014 | |
| JP | 2015503336 | A | 2/2015 | |
| JP | 2015504667 | A | 2/2015 | |
| JP | 2015051015 | A | 3/2015 | |
| JP | 2015514413 | A | 5/2015 | |
| JP | 2015524274 | A | 8/2015 | |
| JP | 2017529896 | A | 10/2017 | |
| KR | 20010049874 | A | 6/2001 | |
| KR | 20120053521 | A | 5/2012 | |
| KR | 20140107372 | A | 9/2014 | |
| KR | 20140118982 | A | 10/2014 | |
| KR | 20140118983 | A | 10/2014 | |
| RU | 2544158 | C1 | 3/2015 | |
| RU | 2665444 | C1 | 8/2018 | |
| RU | 2705507 | C2 | 11/2019 | |
| TW | 391864 | B | 6/2000 | |
| TW | 201345447 | A | 11/2013 | |
| WO | WO-9406314 | A1 | 3/1994 | |
| WO | WO-9632854 | A2 | 10/1996 | |
| WO | WO-9748293 | A1 | 12/1997 | |
| WO | WO-9828994 | A1 | 7/1998 | |
| WO | 9920939 | A1 | 4/1999 | |
| WO | WO-0053037 | A1 | 9/2000 | |
| WO | WO-0130184 | A1 | 5/2001 | |
| WO | WO-0245531 | A1 | 6/2002 | |
| WO | WO-03008068 | A1 | 1/2003 | |
| WO | WO-03034847 | A1 | 5/2003 | |
| WO | WO-2004086888 | A2 | 10/2004 | |
| WO | WO-2004087309 | A1 | 10/2004 | |
| WO | WO-2006048766 | A1 | 5/2006 | |
| WO | WO-2006070291 | A2 | 7/2006 | |
| WO | WO-2006072889 | A1 | 7/2006 | |
| WO | WO-2006089404 | A1 | 8/2006 | |
| WO | WO-2006097427 | A1 | 9/2006 | |
| WO | WO-2006097852 | A1 | 9/2006 | |
| WO | WO-2006103404 | A1 | 10/2006 | |
| WO | WO-2006109189 | A1 | 10/2006 | |
| WO | WO-2007010407 | A2 | 1/2007 | |
| WO | WO-2007031876 | A2 | 3/2007 | |
| WO | 2007110650 | | 4/2007 | |
| WO | WO-2007036814 | A2 | 4/2007 | |
| WO | WO-2007069093 | A2 | 6/2007 | |
| WO | WO-2007110650 | A1 | 10/2007 | |
| WO | WO-2007125426 | A2 | 11/2007 | |
| WO | WO 2008110934 | | 9/2008 | |
| WO | WO-2008110934 | A2 * | 9/2008 | ..... A24D 3/043 |
| WO | WO-2008146548 | A1 | 12/2008 | |
| WO | WO-2009144499 | A2 | 12/2009 | |
| WO | WO-2011000638 | A1 * | 1/2011 | ..... A24D 3/04 |
| WO | WO-2011000639 | A1 | 1/2011 | |
| WO | WO-2011077314 | A1 | 6/2011 | |
| WO | WO-2011121328 | A2 | 10/2011 | |
| WO | WO-2012051548 | A2 | 4/2012 | |
| WO | WO-2012079887 | A1 | 6/2012 | |
| WO | WO 2012126721 | | 9/2012 | |
| WO | WO-2012126721 | A1 * | 9/2012 | ..... A24D 3/043 |
| WO | WO-2012156695 | A1 | 11/2012 | |
| WO | WO-2012156703 | A1 | 11/2012 | |
| WO | WO-2012156705 | A1 | 11/2012 | |
| WO | WO-2012168699 | A1 | 12/2012 | |
| WO | WO-2013034456 | A1 * | 3/2013 | ..... A24F 47/004 |
| WO | WO-2013034458 | A1 | 3/2013 | |
| WO | WO-2013098405 | A2 | 7/2013 | |
| WO | WO-2013098409 | A1 | 7/2013 | |
| WO | WO-2013102309 | A1 | 7/2013 | |
| WO | WO-2013120565 | A2 | 8/2013 | |
| WO | WO-2013164705 | A1 | 11/2013 | |
| WO | WO-2014023555 | A1 | 2/2014 | |
| WO | WO 2014023557 | | 2/2014 | |
| WO | WO-2014116974 | A1 | 7/2014 | |
| WO | WO-2014140273 | A2 * | 9/2014 | ..... A24F 47/006 |
| WO | WO-2014140273 | A3 | 10/2014 | |
| WO | WO-2014158051 | A1 * | 10/2014 | ..... A24D 3/04 |
| WO | 2015028654 | | 3/2015 | |
| WO | 2015028654 | A1 | 3/2015 | |
| WO | WO-2015046385 | A1 | 4/2015 | |
| WO | WO-2015062983 | A2 | 5/2015 | |
| WO | 2015082652 | | 6/2015 | |
| WO | WO-2015082649 | A1 | 6/2015 | |
| WO | WO-2015082651 | A1 | 6/2015 | |
| WO | WO-2015082652 | A1 * | 6/2015 | ..... A24F 47/004 |
| WO | WO-2015128499 | A1 | 9/2015 | |
| WO | 2015176898 | A1 | 11/2015 | |
| WO | WO-2015166245 | A2 | 11/2015 | |
| WO | WO-2015166350 | A2 | 11/2015 | |
| WO | WO-2015179388 | A1 | 11/2015 | |
| WO | WO-2015181354 | A1 * | 12/2015 | ..... A24D 3/0291 |
| WO | WO-2016062777 | A1 | 4/2016 | |
| WO | WO-2016063181 | A1 * | 4/2016 | ..... A24D 3/061 |
| WO | WO-2016207192 | A1 | 12/2016 | |
| WO | WO-2017153443 | A1 | 9/2017 | |
| WO | 2017198838 | A1 | 11/2017 | |
| WO | WO-2017198837 | A1 | 11/2017 | |
| WO | WO-2019166640 | A1 | 9/2019 | |

OTHER PUBLICATIONS

International Preliminary Report on Patentability, Application No. PCT/EP2017/062146, dated Sep. 13, 2017, 15 pages.

Application and File History for U.S. Appl. No. 14/124,637, filed Feb. 7, 2014, Inventor Branton, 468 pages.

Application and File History for U.S. Appl. No. 15/307,074, filed Oct. 27, 2016, Inventor England.

Application and File History for U.S. Appl. No. 15/521,082, filed Apr. 21, 2017, Inventor Aoun, 305 pages.

Application and File History for U.S. Appl. No. 15/553,742, filed Aug. 25, 2017, Inventor Turner, 245 pages.

Application and File History for U.S. Appl. No. 15/553,785, filed Aug. 25, 2017, Inventor Hepworth, 345 pages.

Communication pursuant to Article 94(3) EPC for Application No. 15793718.6, dated Dec. 20, 2018, 5 pages.

Communication pursuant to Article 94(3) EPC for Application No. 15725399.8, dated Jun. 4, 2019, 2 pages.

Examination Report for European Application No. 15725399.8, dated Jun. 4, 2019, 5 pages.

Examination Report dated Dec. 22, 2017 for Australian Application No. 2015334902, 3 pages.

Extended European Search Report for Application No. 20151255.5, dated May 20, 2020, 11 pages.

Extended European Search Report for Application No. 20201803.2, dated Feb. 9, 2021, 7 pages.

First Office Action dated Aug. 26, 2020 for Chinese Application No. 201780030996.2, 13 pages.

International Preliminary Report on Patentability for Application No. PCT/EP2016/054159, dated Jul. 14, 2017, 7 pages.

International Preliminary Report on Patentability for Application No. PCT/EP2016/054232, dated Jul. 3, 2017, 28 pages.

International Preliminary Report on Patentability for Application No. PCT/EP2017/062147, dated Nov. 29, 2018, 9 pages.

International Preliminary Report on Patentability for Application No. PCT/GB2012/051257, dated Jul. 12, 2013, 20 pages.

(56) References Cited

OTHER PUBLICATIONS

International Preliminary Report on Patentability for Application No. PCT/GB2015/051253, dated Nov. 10, 2016, 9 pages.
International Search Report and Written Opinion for Application No. PCT/EP2017/062274, dated Aug. 16, 2017, 11 pages.
International Search Report and Written Opinion for Application No. PCT/GB2012/051257, dated Sep. 17, 2012, 22 pages.
International Search Report and Written Opinion for Application No. PCT/EP2017/062147, dated Sep. 13, 2017, 17 pages.
International Search Report for Application No. PCT/EP2015/074395, dated Feb. 1, 2016, 2 pages.
International Search Report for Application No. PCT/EP2016/054159, dated Jun. 9, 2016, 3 pages.
International Search Report for Application No. PCT/EP2016/054232, dated Aug. 24, 2016, 5 pages.
International Search Report for Application No. PCT/GB2015/051253, dated Nov. 16, 2015, 6 pages.
Jac Vapour, "Round Rubber Mouth Tips," JAC Vapour E-Cigarettes & E-Liquids, retrieved from http://www.jacvapour.com/round-rubber-e-cig-mouth-tips on May 29, 2015, 2 pages.
Merriam-Webster Dictionary, Definition of "throughout," the Free Merriam-Webster Dictionary, Mar. 7, 2015, http://www.merriam-webster.com/dictionary/throughout, 15 pages.
Office Action and Search Report dated Oct. 6, 2020 for Taiwan Application No. 106115468, 7 pages.
Office Action and Search Report dated Oct. 30, 2020 for Taiwan Application No. 106115467, 10 pages.
Office Action dated Feb. 18, 2020 for Japanese Application No. 2018-560760, 8 pages.
Office Action dated Nov. 22, 2019 for Canadian Application No. 3024662, 4 pages.
Office Action dated Jun. 23, 2020 for Canadian Application No. 3024764, 4 pages.
Office Action dated Aug. 25, 2020 for Japanese Application No. 2018-560760, 10 pages.
Office Action For Canadian Application No. 3,024,764, dated Dec. 31, 2020, 5 pages.
Office Action For Chilean Application No. 201803259, dated Jan. 10, 2021, 13 pages.
Office Action For Korean Application No. 2019-7029261, dated Dec. 31, 2020, 12 pages.
Office Action For Russian Application No. 2020124710, dated Nov. 26, 2020, 2 pages.
Office Action dated Jul. 1, 2020 for Chinese Application No. 201780031025.X, 23 pages.
Office Action dated Apr. 12, 2020 for Chilean Application No. 201803259, 15 pages.
Office Action dated Jul. 15, 2020 for Japanese Application No. 2018-201388, 5 pages.
Office Action dated Jun. 16, 2020 for Japanese Application No. 2018-560169, 8 pages.
Office Action dated Feb. 18, 2020 for Japanese Application No. 2018-560169, 8 pages.
Office Action dated Jun. 18, 2019 for Russian Application No. 2018140773, 14 pages.
Office Action dated Jul. 2, 2018 for Chinese Application No. 201580023549.5, 23 pages.
Office Action dated Nov. 21, 2018 for Korean Application No. 10-2018-7021103, 15 pages.
Office Action dated Jun. 23, 2020 for Korean Application No. 10-2018-7021103, 16 pages.
Office Action dated Oct. 27, 2020 for Japanese Application No. 2018-560169, 5 pages.
Office Action dated Jun. 29, 2020 for Canadian Application No. 3024662, 5 pages.
Office Action dated Nov. 30, 2018 for Korean Application No. 10-2018-7021106, 11 pages.
Office Action dated Oct. 30, 2018 for Japanese Application No. 2017-545245, 22 pages.
Office Action dated Oct. 30, 2018 for Korean Application No. 1020177013874, 19 pages.
Office Action dated Feb. 4, 2020 for Japanese Application No. 2018-559838, 14 pages.
Office Action dated Feb. 5, 2019 for Japanese Application No. 2017-522122, 14 pages.
Office Action dated Nov. 6, 2018 for Japanese Application No. 2017-545230, 10 pages.
Partial International Search Report for Application No. PCT/EP2016/054232, dated Jun. 22, 2016, 6 pages.
Search Report dated Mar. 21, 2016 for Great Britain Application No. 1517470.9, 4 pages.
Swift J.L., et al., "Viscometric Method for Determining Free Menthol in Peppermint Oil," Industrial & Engineering Chemistry Analytical Edition, vol. 15, No. 7, Jul. 1943, pp. 422-423.
Verma R.S., et al., "Essential Oil Composition of Menthol Mint (*Mentha aervensis* L.) and Peppermint (*Mentha piperita* L.) Cultivars at Different Stages of Plant Growth from Kumaon Region of Western Himalaya," XP055395671, Open Access Journal of Medicinal and Aromatic Plants, Jan. 1, 2010, pp. 13-18.
Written Opinion for Application No. PCT/GB2015/051253, dated Nov. 16, 2015, 7 pages.
Written Opinion of the International Preliminary Examining Authority for Application No. PCT/GB2012/051257, dated May 29, 2013, 7 pages.
Application and File History for U.S. Appl. No. 16/302,690, filed Nov. 19, 2018, inventors England, et al., 322 pages.
Notice of Opposition mailed Feb. 15, 2021 for European Application No. 17728783.6, 42 pages.
Office Action For Canadian Application No. 3,024,764, dated Sep. 2, 2021, 6 pages.
"Accord Operating Guide", JT/ international S.A, EZ13399, ownr's gd.RA, 23 pages.
"Employee Owner's Guide", Dec. 1, 2004, Retrieved from https://www.industrydocuments.ucsf.edu/docs/#id=zkwl0151, 15 pages.
Extended European Search Report for Application No. 20201801.6, mailed on Jun. 11, 2021, 12 pages.
Office Action for Brazilian Application No. 112018073462.4, dated Aug. 19, 2021, 4 pages.
Office Action for Japanese Application No. 2020-031893, mailed on Sep. 14, 2021, 5 pages.
Search Report mailed Sep. 27, 2022 for Taiwan Application No. 110142026, 1 page.
"Notice of Reasons for Rejection received for Japanese Patent Application No. 2022-065641, mailed on Apr. 4, 2023", 5 pages (English Translation Only).
"Office Action received for Chinese Patent Application No. 201780031025.X, mailed on Oct. 8, 2023", 9 pages (English Translation Only).
"Reasons for Refusal received for Japanese Patent Application No. 2020-187871, mailed on Oct. 3, 2023", 23 pages (11 pages of English Translation & 12 pages of Official Copy).
"A New Smoking System", Press release for Philip Morris Records, retrieved from https://www.industrydocuments.ucsf.edu/docs/jynm0151, Apr. 25, 1999, pp. 1-21.
"Accord lighter device and Oasis Cigarette", Exhibit D21, 1999, 3 pages.
"Brief Communication Regarding Opposition Proceedings received for European Patent Application No. 17728784.4, mailed on Sep. 15, 2023", 53 pages.
"Cigarettes—Determination of ventilation—Definitions and measurement principles", International Standard ISO 9512:2002(E), 2002, 24 pages.
"Focus on the filter", Tobacco Reporter, Retrieved from https://tobaccoreporter.com/2016/08/01/focus-on-the-filter/, Aug. 1, 2016, 3 pages.
"IQOS2.2 Device and Marlboro Cigarettes", Exhibit D23, 2014, 2 pages.
"Office Action received for Canadian Patent Application No. 3,024,764, mailed on Mar. 26, 2024", 6 pages.
"Segment Definition & Meaning", Merriam-Webster, Retrieved from https://www.merriam-webster.com/dictionary/segment.

(56) References Cited

OTHER PUBLICATIONS

Davis , et al., "Tobacco Production, Chemistry and Technology", Wiley ISBN: 978-0-632-04791-8, 1999, 20 pages.
Forster , et al., "An experimental method to study emissions from heated tobacco between 100-200° C.", Chemistry Central Journal vol. 9, No. 20, 2015, pp. 1-10.
CA Office Action in CA Appln. No. 3024764, dated Mar. 26, 2024, 6 pages.

* cited by examiner

ARTICLE FOR USE IN AN APPARATUS FOR HEATING SMOKABLE MATERIAL

PRIORITY CLAIM

The present application is a National Phase entry of PCT Application No. PCT/EP2017/062146, filed May 19, 2017, which claims priority from GB Patent Application No. 1608928.6, filed May 20, 2016, each of which is hereby fully incorporated herein by reference.

TECHNICAL FIELD

The present disclosure relates to an article for use with an apparatus for heating smokable material to volatilize at least one component of the smokable material, to an apparatus for heating smokable material to volatilize at least one component of the smokable material, and to a kit comprising the article and the apparatus.

BACKGROUND

Articles such as cigarettes, cigars and the like burn tobacco during use to create tobacco smoke. Attempts have been made to provide alternatives to these articles by creating products that release compounds without combusting. Examples of such products are so-called "heat not burn" products, also known as tobacco heating products or tobacco heating apparatus, which release compounds by heating, but not burning, material. The material may be for example tobacco or other non-tobacco products or a combination, such as a blended mix, which may or may not contain nicotine.

SUMMARY

According to a first aspect of the present disclosure, there is provided a smoking article for use with an apparatus for heating smokable material to volatilize at least one component of the smokable material, the article comprising: a body of smokable material; and an assembly comprising: a cooling segment of between 20 mm and 30 mm in length for cooling the volatilized at least one component of the smokable material; a filter segment adjacent to the cooling segment for filtering the volatilized at least one component of the smokable material; and a mouth end segment adjacent to the filter segment for being received in a mouth of a user; wherein the cooling segment is located between the body of smokable material and the filter segment.

In an exemplary embodiment, the cooling segment comprises a hollow tube. According to a second aspect of the present disclosure, there is provided a system comprising a heating apparatus arranged to heat smokable material to volatilize at least one component of the smokable material and a smoking article for insertion into the heating apparatus, wherein the heating apparatus comprises: a housing having a first opening at a first end through which the smoking article can be inserted into the heating apparatus; and at least one heater arrangement arranged within the housing for heating the smokable material of the smoking article when in use.

BRIEF DESCRIPTION OF THE DRAWINGS

Embodiments of the disclosure will now be described, by way of example only, with reference to the accompanying drawings, in which.

DETAILED DESCRIPTION

As used herein, the term "smokable material" includes materials that provide volatilized components upon heating, typically in the form of an aerosol. "Smokable material" may be a non-tobacco-containing material or a tobacco-containing material. "Smokable material" may, for example, include one or more of tobacco per se, tobacco derivatives, expanded tobacco, reconstituted tobacco, tobacco extract, homogenized tobacco or tobacco substitutes. The smokable material can be in the form of ground tobacco, cut rag tobacco, extruded tobacco, gel or agglomerates. "Smokable material" also may include other, non-tobacco, products, which, depending on the product, may or may not contain nicotine.

As used herein, "polyimide" refers to any polymer comprising or substantially formed of imide monomers and may be saturated or unsaturated. The polyimide may be hydrophobic.

As used herein, the terms "flavor" and "flavorant" refer to materials which, where local regulations permit, may be used to create a desired taste or aroma in a product for adult consumers. They may include extracts (e.g., licorice, *hydrangea*, Japanese white bark *magnolia* leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, *cassia*, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may comprise natural or nature-identical aroma chemicals. They may be in any suitable form, for example, oil, liquid, powder, or gel.

As used herein, "annular" means ring-shaped or in the form of a ring. "Annular" does not itself mean circular. In some embodiments, an element that is described herein as "annular" may indeed be circular, but in other embodiments the element may be "annular" and other than circular, such as elliptical or polygonal.

Figure 1:
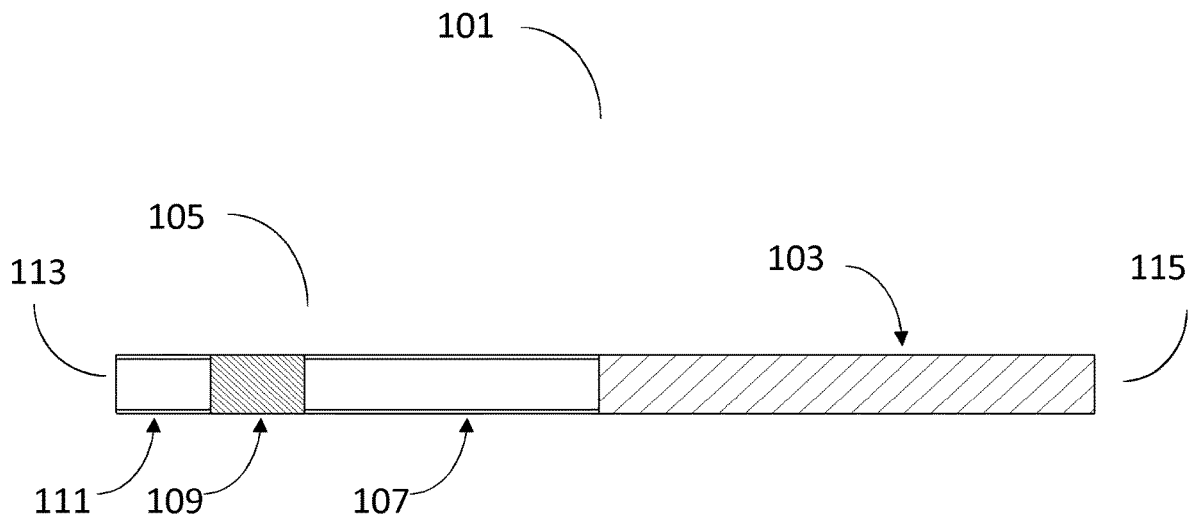
FIG. 1 shows a partially cut-away section view of an example of an article for use with an apparatus for heating smokable material to volatilize at least one component of the smokable material.
Figure 2:
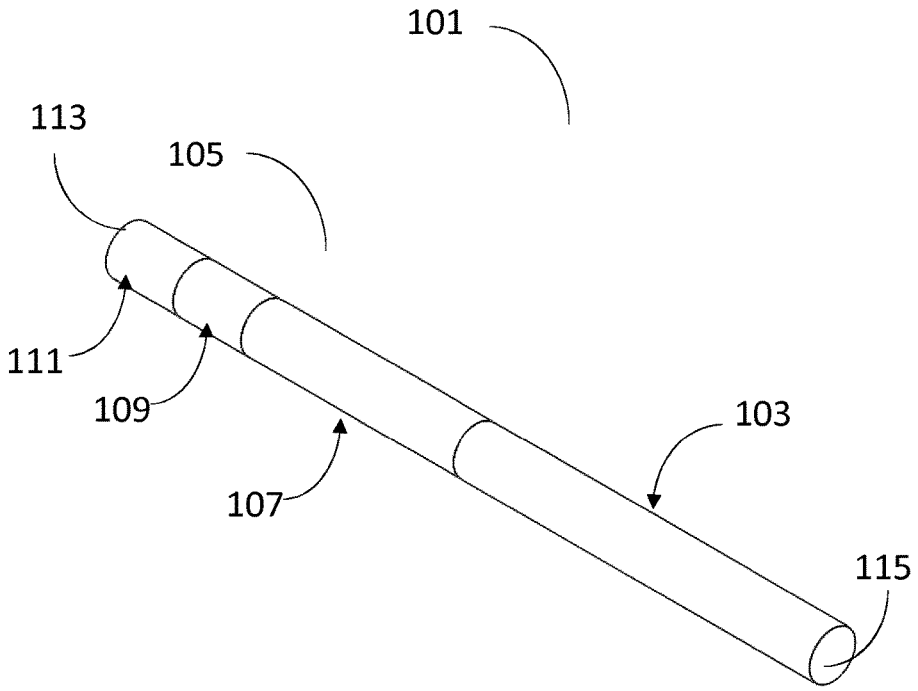
FIG. 2 shows a perspective view of the article of FIG. 1.

Referring to FIGS. 1 and 2, there are shown a partially cut-away section view and a perspective view of an example of a smoking article 101 according to an embodiment of the disclosure. The article 101 is adapted for use with an apparatus having a power source and a heater. The article 101 of this embodiment is particularly suitable for use with the apparatus 1 shown in FIGS. 5 to 7, described below. In use, the article 101 may be removably inserted into the apparatus shown in FIG. 5 at an insertion point 20 of the apparatus 1.

The article 101 of one example is in the form of a substantially cylindrical rod that includes a body of smokable material 103 and a filter assembly 105 in the form of a rod. The filter assembly 105 includes three segments, a cooling segment 107, a filter segment 109 and a mouth end segment 111. The article 101 has a first end 113, also known as a mouth end, or a proximal end and a second end 115, also known as a distal end. The body of smokable material 103 is located towards the distal end 115 of the article 101. In one example, the cooling segment 107 is located adjacent the body of smokable material 103 between the body of smokable material 103 and the filter segment 109, such that the cooling segment 107 is in an abutting relationship with the body of smokable material 103 and the filter segment 109. In other examples, there may be a separation between the body of smokable material 103 and the cooling segment 107 and between the body of smokable material 103 and the filter segment 109. The filter segment 109 is located in between the cooling segment 107 and the mouth end segment 111. The mouth end segment 111 is located towards the proximal end 113 of the article 101, adjacent the filter segment 109. In one example, the filter segment 109 is in an abutting relationship with the mouth end segment 111. In one embodiment, the total length of the filter assembly 105 is between 37 mm and 45 mm, for example the total length of the filter assembly 105 is 41 mm.

In one embodiment, the body of smokable material 103 comprises tobacco. However, in other respective embodiments, the body of smokable material 103 may consist of tobacco, may consist substantially entirely of tobacco, may comprise tobacco and smokable material other than tobacco, may comprise smokable material other than tobacco, or may be free of tobacco. The smokable material may include an aerosol forming agent, such as glycerol.

In one example, the body of smokable material 103 is between 34 mm and 50 mm in length, such as the body of smokable material 103 is between 38 mm and 46 mm in length, for example the body of smokable material 103 is 42 mm in length.

In one example, the total length of the article 101 is between 71 mm and 95 mm, such as total length of the article 101 is between 79 mm and 87 mm, for example total length of the article 101 is 83 mm.

An axial end of the body of smokable material 103 is visible at the distal end 115 of the article 101. However, in other embodiments, the distal end 115 of the article 101 may comprise an end member (not shown) covering the axial end of the body of smokable material 103.

The body of smokable material 103 is joined to the filter assembly 105 by annular tipping paper (not shown), which is located substantially around the circumference of the filter assembly 105 to surround the filter assembly 105 and extends partially along the length of the body of smokable material 103. In one example, the tipping paper is made of 58 GSM standard tipping base paper. In one example has a length of between 42 mm and 50 mm, for example the tipping paper has a length of 46 mm.

In one example, the cooling segment 107 is an annular tube and is located around and defines an air gap within the cooling segment. The air gap provides a chamber for heated volatilized components generated from the body of smokable material 103 to flow. The cooling segment 107 is hollow to provide a chamber for aerosol accumulation yet rigid enough to withstand axial compressive forces and bending moments that might arise during manufacture and whilst the article 101 is in use during insertion into the apparatus 1. In one example, the thickness of the wall of the cooling segment 107 is approximately 0.29 mm.

The cooling segment 107 provides a physical displacement between the body of smokable material 103 and the filter segment 109. The physical displacement provided by the cooling segment 107 will provide a thermal gradient across the length of the cooling segment 107. In one example the cooling segment 107 is configured to provide a temperature differential of at least 40 degrees Celsius between a heated volatilized component entering a first end of the cooling segment 107 and a heated volatilized component exiting a second end of the cooling segment 107. In one example the cooling segment 107 is configured to provide a temperature differential of at least 60 degrees Celsius between a heated volatilized component entering a first end of the cooling segment 107 and a heated volatilized component exiting a second end of the cooling segment 107. This temperature differential across the length of the cooling element 107 protects the temperature sensitive filter segment 109 from the high temperatures of the body of smokable material 103 when it is heated by the heating arrangement of the apparatus 1. If the physical displacement was not provided between the filter segment 109 and the body of smokable material 103 and the heating elements of the apparatus 1, then the temperature sensitive filter segment 109 may become damaged in use, so it would not perform its required functions as effectively.

In one example the length of the cooling segment 107 is at least 15 mm. In one example, the length of the cooling segment 107 is between 20 mm and 30 mm, such as 23 mm to 27 mm, 25 mm to 27 mm or particularly 25 mm.

The cooling segment 107 is made of paper, which means that it is comprised of a material that does not generate compounds of concern, for example, toxic compounds when in use adjacent to the heater arrangement of the apparatus 1. In one example, the cooling segment 107 is manufactured from a spirally wound paper tube which provides a hollow internal chamber yet maintains mechanical rigidity. Spirally wound paper tubes are able to meet the tight dimensional accuracy requirements of high-speed manufacturing processes with respect to tube length, outer diameter, roundness and straightness.

In another example, the cooling segment 107 is a recess created from stiff plug wrap or tipping paper. The stiff plug wrap or tipping paper is manufactured to have a rigidity that is sufficient to withstand the axial compressive forces and bending moments that might arise during manufacture and whilst the article 101 is in use during insertion into the apparatus 1.

For each of the examples of the cooling segment 107, the dimensional accuracy of the cooling segment is sufficient to meet the dimensional accuracy requirements of high-speed manufacturing process.

The filter segment 109 may be formed of any filter material sufficient to remove one or more volatilized compounds from heated volatilized components from the smokable material. In one example the filter segment 109 is made of a mono-acetate material, such as cellulose acetate. The filter segment 109 provides cooling and irritation-reduction from the heated volatilized components without depleting the quantity of the heated volatilized components to an unsatisfactory level for a user.

The density of the cellulose acetate tow material of the filter segment 109 controls the pressure drop across the filter segment 109, which in turn controls the draw resistance of the article 1. Therefore the selection of the material of the filter segment 109 is important in controlling the resistance to draw of the article 101. In addition, the filter segment performs a filtration function in the article 101.

In one example, the filter segment 109 is made of a 8Y15 grade of filter tow material, which provides a filtration effect on the heated volatilized material, whilst also reducing the size of condensed aerosol droplets which result from the heated volatilized material which consequentially reduces the irritation and throat impact of the heated volatilized material to satisfactory levels.

The presence of the filter segment 109 provides an insulating effect by providing further cooling to the heated volatilized components that exit the cooling segment 107. This further cooling effect reduces the contact temperature of the user's lips on the surface of the filter segment 109.

One or more flavors may be added to the filter segment 109 in the form of either direct injection of flavored liquids into the filter segment 109 or by embedding or arranging one or more flavored breakable capsules or other flavor carriers within the cellulose acetate tow of the filter segment 109.

In one example, the filter segment 109 is between 6 mm to 10 mm in length, for example 8 mm.

The mouth end segment 111 is an annular tube and is located around and defines an air gap within the mouth end segment 111. The air gap provides a chamber for heated volatilized components that flow from the filter segment 109. The mouth end segment 111 is hollow to provide a chamber for aerosol accumulation yet rigid enough to withstand axial compressive forces and bending moments that might arise during manufacture and whilst the article is in use during insertion into the apparatus 1. In one example, the thickness of the wall of the mouth end segment 111 is approximately 0.29 mm.

In one example, the length of the mouth end segment 111 is between 6 mm to 10 mm, for example 8 mm. In one example, the thickness of the mouth end segment is 0.29 mm.

The mouth end segment 111 may be manufactured from a spirally wound paper tube which provides a hollow internal chamber yet maintains critical mechanical rigidity. Spirally wound paper tubes are able to meet the tight dimensional accuracy requirements of high-speed manufacturing processes with respect to tube length, outer diameter, roundness and straightness.

The mouth end segment 111 provides the function of preventing any liquid condensate that accumulates at the exit of the filter segment 109 from coming into direct contact with a user.

It should be appreciated that, in one example, the mouth end segment 111 and the cooling segment 107 may be formed of a single tube and the filter segment 109 is located within that tube separating the mouth end segment 111 and the cooling segment 107.

Figure 3:
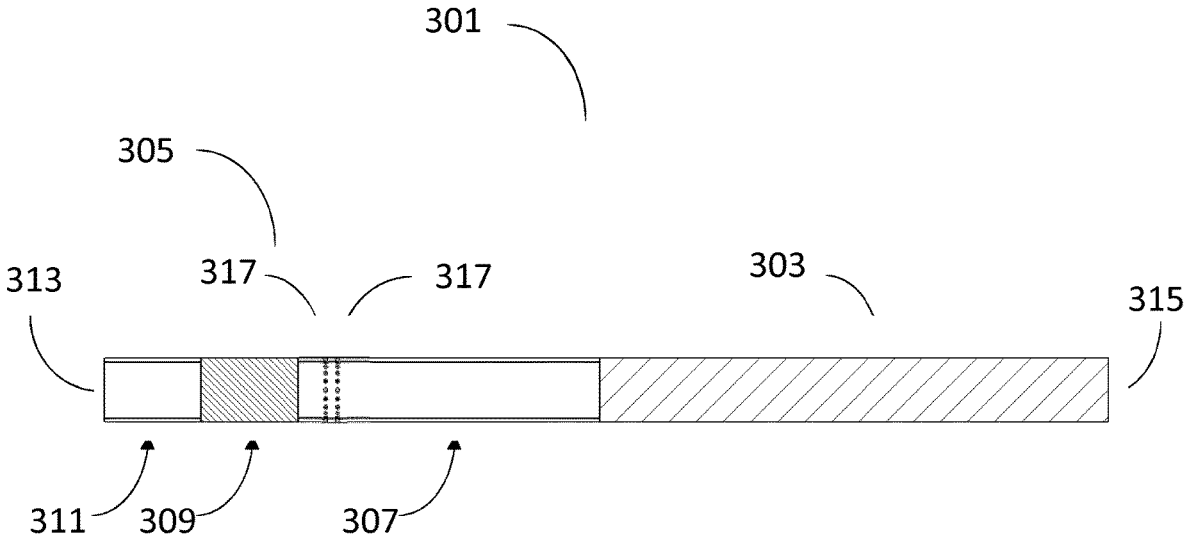
FIG. 3 shows a partially cut-away section view of an example of an article for use with an apparatus for heating smokable material to volatilize at least one component of the smokable material.
Figure 4:
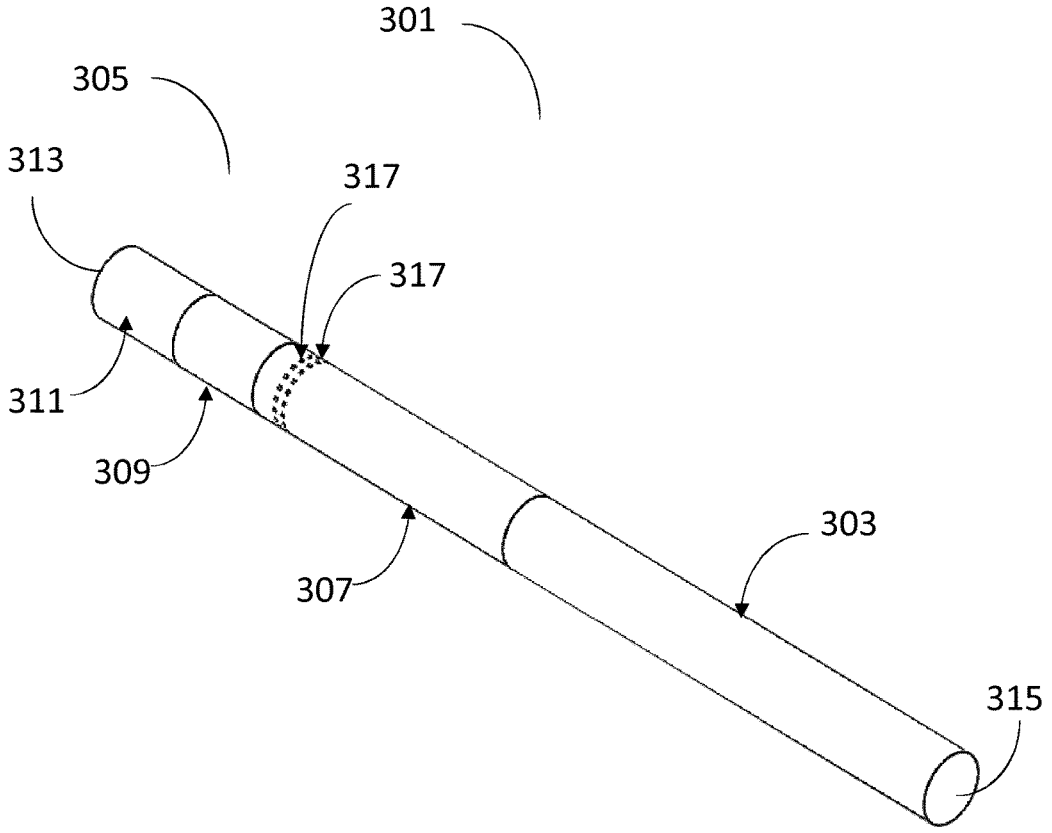
FIG. 4 shows a perspective view of an example of an article for use with an apparatus for heating smokable material to volatilize at least one component of the smokable material.

Referring to FIGS. 3 and 4, there are shown a partially cut-away section and perspective views of an example of an article 301 according to an embodiment of the disclosure. The reference signs shown in FIGS. 3 and 4 are equivalent to the reference signs shown in FIGS. 1 and 2, but with an increment of 200.

In the example of the article 301 shown in FIGS. 3 and 4, a ventilation region 317 is provided in the article 301 to enable air to flow into the interior of the article 301 from the exterior of the article 301. In one example the ventilation region 317 takes the form of one or more ventilation holes 317 formed through the outer layer of the article 301. The ventilation holes may be located in the cooling segment 307 to aid with the cooling of the article 301. In one example, the ventilation region 317 comprises one or more rows of holes, and in some embodiments, each row of holes is arranged circumferentially around the article 301 in a cross-section that is substantially perpendicular to a longitudinal axis of the article 301.

In one example, there are between one to four rows of ventilation holes to provide ventilation for the article 301. Each row of ventilation holes may have between 12 to 36 ventilation holes 317. The ventilation holes 317 may, for example, be between 100 to 500 μm in diameter. In one example, an axial separation between rows of ventilation holes 317 is between 0.25 mm and 0.75 mm, for example an axial separation between rows of ventilation holes 317 is 0.5 mm.

In one example, the ventilation holes 317 are of uniform size. In another example, the ventilation holes 317 vary in size. The ventilation holes can be made using any suitable technique, for example, one or more of the following techniques: laser technology, mechanical perforation of the cooling segment 307 or pre-perforation of the cooling segment 307 before it is formed into the article 301. The ventilation holes 317 are positioned so as to provide effective cooling to the article 301.

In one example, the rows of ventilation holes 317 are located at least 11 mm from the proximal end 313 of the article, more preferably the ventilation holes are located between 17 mm and 20 mm from the proximal end 313 of the article 301. The location of the ventilation holes 317 is positioned such that user does not block the ventilation holes 317 when the article 301 is in use.

Figure 6:
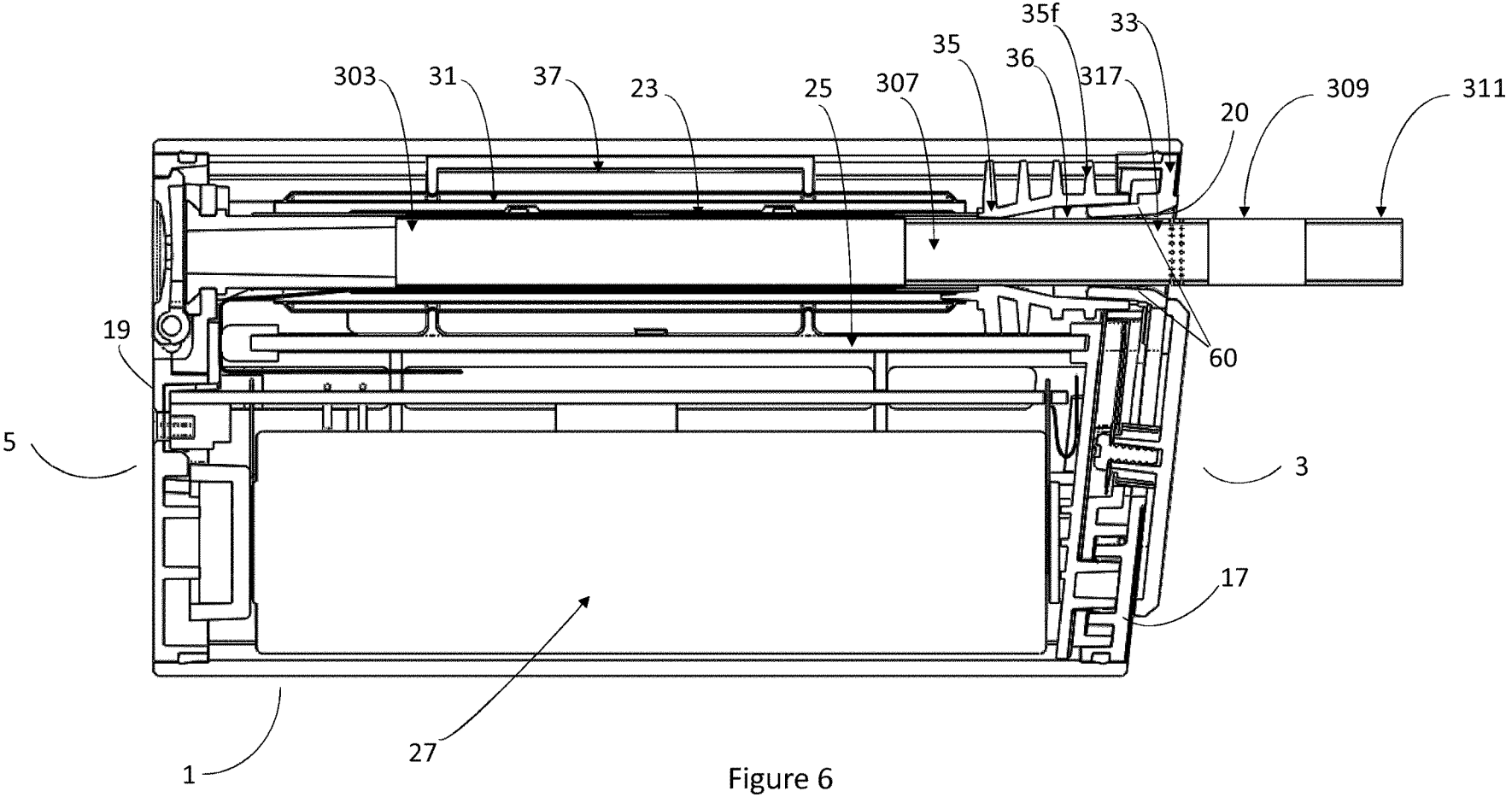
FIG. 6 shows a partially cut-away section view of an example of the article inserted into the smoking apparatus.
Figure 7:
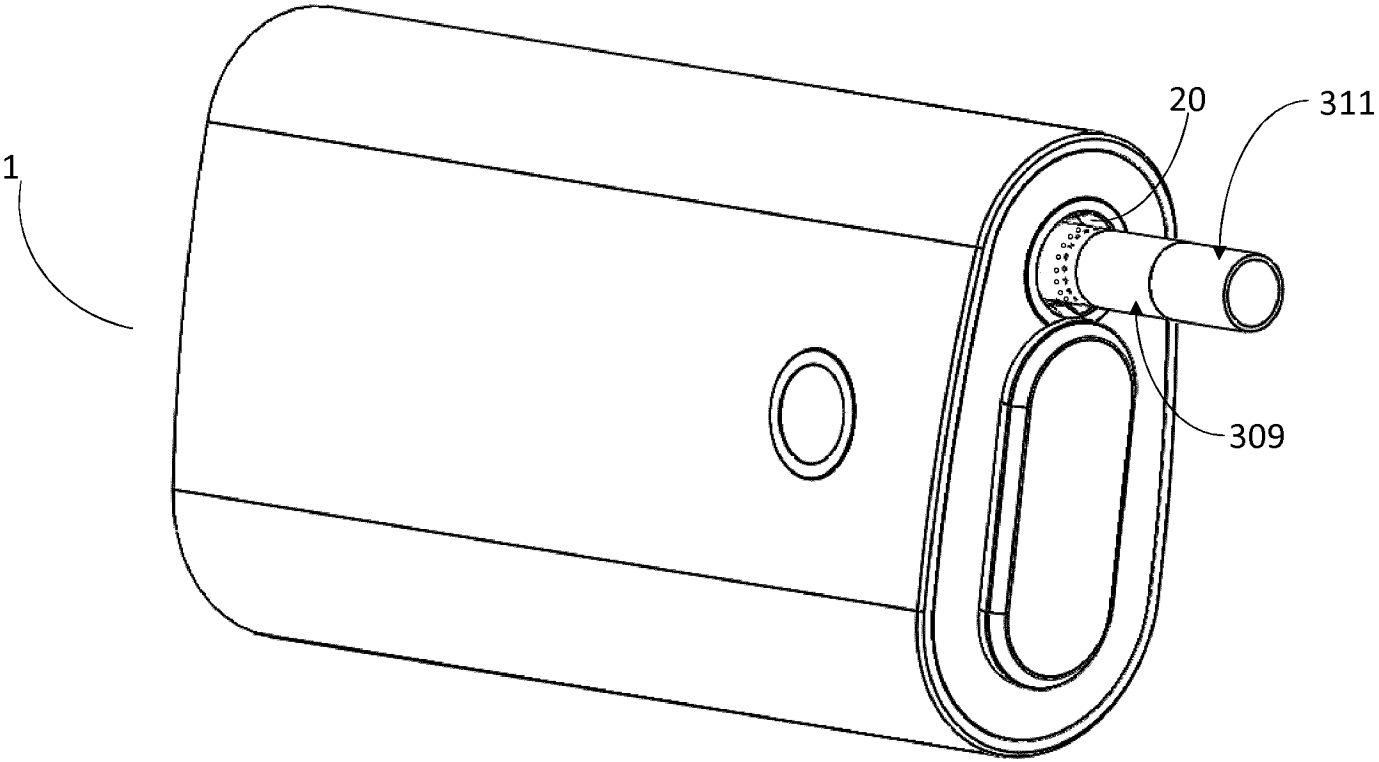
FIG. 7 shows a perspective view of an example of the article inserted into the smoking apparatus.

Advantageously, providing the rows of ventilation holes between 17 mm and 20 mm from the proximal end 313 of the article 301 enables the ventilation holes 317 to be located outside of the apparatus 1, when the article 301 is fully inserted in the apparatus 1, as can be seen in FIGS. 6 and 7. By locating the ventilation holes outside of the apparatus, non-heated air is able to enter the article 301 through the ventilation holes from outside the apparatus 1 to aid with the cooling of the article 301.

The length of the cooling segment 307 is such that the cooling segment 307 will be partially inserted into the apparatus 1, when the article 301 is fully inserted into the apparatus 1. The length of the cooling segment 307 provides a first function of providing a physical gap between the heater arrangement of the apparatus 1 and the heat sensitive filter arrangement 309, and a second function of enabling the ventilation holes 317 to be located in the cooling segment, whilst also being located outside of the apparatus 1, when the article 301 is fully inserted into the apparatus 1. As can be seen from FIGS. 6 and 7, the majority of the cooling element 307 is located within the apparatus 1. However, there is a portion of the cooling element 307 that extends out of the apparatus 1. It is in this portion of the cooling element 307 that extends out of the apparatus 1 in which the ventilation holes 317 are located.

Figure 5:
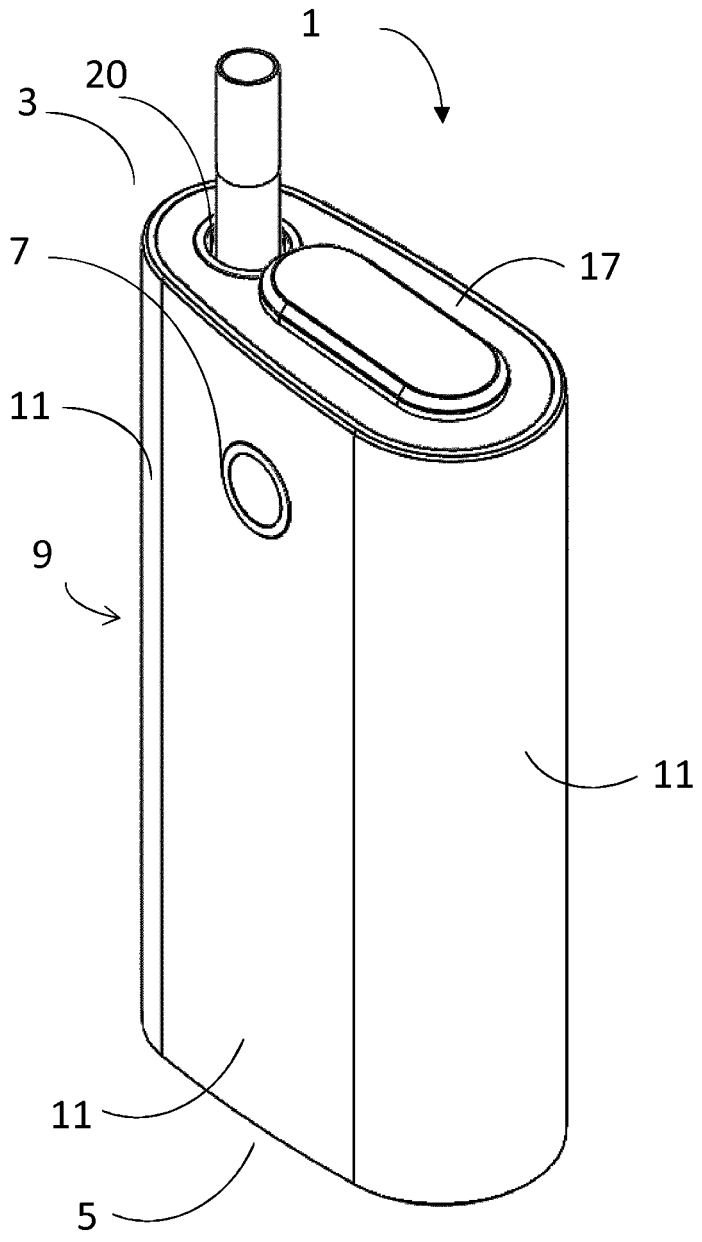
FIG. 5 shows a perspective view of an example of the article inserted into the smoking apparatus.

Referring now to FIGS. 5 to 7 in more detail, there is shown an example of an apparatus 1 arranged to heat smokable material to volatilize at least one component of [[said]] the smokable material, typically to form an aerosol which can be inhaled. The apparatus 1 is a heating apparatus 1 which releases compounds by heating, but not burning, the smokable material.

A first end 3 is sometimes referred to herein as the mouth or proximal end 3 of the apparatus 1 and a second end 5 is sometimes referred to herein as the distal end 5 of the apparatus 1. The apparatus 1 has an on/off button 7 to allow the apparatus 1 as a whole to be switched on and off as desired by a user.

The apparatus 1 comprises a housing 9 for locating and protecting various internal components of the apparatus 1. In the example shown, the housing 9 comprises a uni-body sleeve 11 that encompasses the perimeter of the apparatus 1, capped with a top panel 17 which defines generally the "top" of the apparatus 1 and a bottom panel 19 which defines generally the "bottom" of the apparatus 1. In another example the housing comprises a front panel, a rear panel and a pair of opposite side panels in addition to the top panel 17 and the bottom panel 19.

The top panel 17 and/or the bottom panel 19 may be removably fixed to the uni-body sleeve 11, to permit easy access to the interior of the apparatus 1, or may be "permanently" fixed to the uni-body sleeve 11, for example to deter a user from accessing the interior of the apparatus 1. In an example, the panels 17 and 19 are made of a plastic material, including for example glass-filled nylon formed by injection molding, and the uni-body sleeve 11 is made of aluminum, though other materials and other manufacturing processes may be used.

The top panel 17 of the apparatus 1 has an opening 20 at the mouth end 3 of the apparatus 1 through which, in use, the article 101, 301 including smokable material may be inserted into the apparatus 1 and removed from the apparatus 1 by a user.

The housing 9 has located or fixed therein a heater arrangement 23, control circuitry 25 and a power source 27. In this example, the heater arrangement 23, the control circuitry 25 and the power source 27 are laterally adjacent (that is, adjacent when viewed from an end), with the control circuitry 25 being located generally between the heater arrangement 23 and the power source 27, though other locations are possible.

The control circuitry 25 may include a controller, such as a microprocessor arrangement, configured and arranged to control the heating of the smokable material in the consumable article 101, 301 as discussed further below.

The power source 27 may be for example a battery, which may be a rechargeable battery or a non-rechargeable battery. Examples of suitable batteries include for example a lithium-ion battery, a nickel battery (such as a nickel-cadmium battery), an alkaline battery and/or the like. The battery 27 is electrically coupled to the heater arrangement 23 to supply electrical power when required and under control of the control circuitry 25 to heat the smokable material in the article (as discussed, to volatilize the smokable material without causing the smokable material to burn).

An advantage of locating the power source 27 laterally adjacent to the heater arrangement 23 is that a physically large power source 27 may be used without causing the apparatus 1 as a whole to be unduly lengthy. As will be understood, in general a physically large power source 27 has a higher capacity (that is, the total electrical energy that can be supplied, often measured in Amp-hours or the like) and thus the battery life for the apparatus 1 can be longer.

In one example, the heater arrangement 23 is generally in the form of a hollow cylindrical tube, having a hollow interior heating chamber into which the article 101, 301 comprising the smokable material is inserted for heating in use. Different arrangements for the heater arrangement 23 are possible. For example, the heater arrangement 23 may comprise a single heating element or may be formed of plural heating elements aligned along the longitudinal axis of the heater arrangement 23. The or each heating element may be annular or tubular, or at least part-annular or part-tubular around its circumference. In an example, the or each heating element may be a thin film heater. In another example, the or each heating element may be made of a ceramics material. Examples of suitable ceramics materials include alumina and aluminum nitride and silicon nitride ceramics, which may be laminated and sintered. Other heating arrangements are possible, including for example inductive heating, infrared heater elements, which heat by emitting infrared radiation, or resistive heating elements formed by for example a resistive electrical winding.

In one particular example, the heater arrangement 23 is supported by a stainless steel support tube and comprises a polyimide heating element. The heater arrangement 23 is dimensioned so that substantially the whole of the body of smokable material 103, 303 of the article 101, 301 is inserted into the heater arrangement 23 when the article 101, 301 is inserted into the apparatus 1.

The or each heating element may be arranged so that selected zones of the smokable material can be independently heated, for example in turn (over time) or together (simultaneously) as desired.

The heater arrangement 23 in this example is surrounded along at least part of its length by a thermal insulator 31. The insulator 31 helps to reduce heat passing from the heater arrangement 23 to the exterior of the apparatus 1. This helps to keep down the power requirements for the heater arrangement 23 as it reduces heat losses generally. The insulator 31 also helps to keep the exterior of the apparatus 1 cool during operation of the heater arrangement 23. In one example, the insulator 31 may be a double-walled sleeve which provides a low pressure region between the two walls of the sleeve. That is, the insulator 31 may be for example a "vacuum" tube, i.e. a tube that has been at least partially evacuated so as to minimize heat transfer by conduction and/or convection. Other arrangements for the insulator 31 are possible, including using heat insulating materials, including for example a suitable foam-type material, in addition to or instead of a double-walled sleeve.

The housing 9 may further comprise various internal support structures 37 for supporting all internal components, as well as the heating arrangement 23.

The apparatus 1 further comprises a collar 33 which extends around and projects from the opening 20 into the interior of the housing 9 and a generally tubular chamber 35 which is located between the collar 33 and one end of the vacuum sleeve 31. The chamber 35 further comprises a cooling structure **35*f*, which in this example, comprises a plurality of cooling fins 35*f* spaced apart along the outer surface of the chamber 35, and each arranged circumferentially around outer surface of the chamber 35. There is an air gap 36 between the hollow chamber 35 and the article 101, 301 when it is inserted in the apparatus 1 over at least part of the length of the hollow chamber 35. The air gap 36 is around all of the circumference of the article 101, 301 over at least part of the cooling segment 307**.

The collar 33 comprises a plurality of ridges 60 arranged circumferentially around the periphery of the opening 20 and which project into the opening 20. The ridges 60 take up space within the opening 20 such that the open span of the opening 20 at the locations of the ridges 60 is less than the open span of the opening 20 at the locations without the ridges 60. The ridges 60 are configured to engage with an article 101, 301 inserted into the apparatus to assist in securing it within the apparatus 1. Open spaces (not shown in the Figures) defined by adjacent pairs of ridges 60 and the article 101, 301 form ventilation paths around the exterior of the article 101, 301. These ventilation paths allow hot vapors that have escaped from the article 101, 301 to exit the apparatus 1 and allow cooling air to flow into the apparatus 1 around the article 101, 301 in the air gap 36.

In operation, the article 101, 301 is removably inserted into an insertion point 20 of the apparatus 1, as shown in FIGS. 5 to 7. Referring particularly to FIG. 6, in one example, the body of smokable material 103, 303, which is located towards the distal end 115, 315 of the article 101, 301, is entirely received within the heater arrangement 23 of the apparatus 1. The proximal end 113, 313 of the article 101, 301 extends from the apparatus 1 and acts as a mouthpiece assembly for a user.

In operation, the heater arrangement 23 will heat the consumable article 101, 301 to volatilize at least one component of the smokable material from the body of smokable material 103, 303.

The primary flow path for the heated volatilized components from the body of smokable material 103, 303 is axially through the article 101, 301, through the chamber inside the cooling segment 107, 307, through the filter segment 109, 309, through the mouth end segment 111, 311 to the user. In one example, the temperature of the heated volatilized components that are generated from the body of smokable material is between 60° C. and 250° C., which may be above the acceptable inhalation temperature for a user. As the heated volatilized component travels through the cooling segment 107, 307, it will cool and some volatilized components will condense on the inner surface of the cooling segment 107, 307.

In the examples of the article 301 shown in FIGS. 3 and 4, cool air will be able to enter the cooling segment 307 via the ventilation holes 317 formed in the cooling segment 307. This cool air will mix with the heated volatilized components to provide additional cooling to the heated volatilized components.

The ventilation enhances the generation of visible heated volatilized components from the article 301 when it is heated in use by the apparatus 1. The heated volatilized components are made visible by the process of cooling the heated volatilized components such that supersaturation of the heated volatilized components occurs. The heated volatilized components then undergo droplet formation, otherwise known as nucleation, and eventually the size of the aerosol particles of the heated volatilized components increases by further condensation of the heated volatilized components and by coagulation of newly formed droplets from the heated volatilized components.

In one embodiment, the ratio of the cool air to the sum of the heated volatilized components and the cool air, known as the ventilation ratio, is at least 15%. A ventilation ratio of 15% enables the heated volatilized components to be made visible by the method described above. The visibility of the heated volatilized components enables the user to identify that the volatilized components have been generated and adds to the sensory experience of the smoking experience.

In another example, the ventilation ratio is between 50% and 85% to provide additional cooling to the heated volatilized components.

In order to address various issues and advance the art, the entirety of this disclosure shows by way of illustration and example various embodiments in which the claimed invention may be practiced and which provide for a superior article for use with an apparatus for heating smokable material to volatilize at least one component of the smokable material. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. A smoking article for use with a heating apparatus for heating smokable material to volatilize at least one component of the smokable material, the article comprising:

a body of the smokable material; and an assembly comprising:

a cooling segment for cooling the volatilized at least one component of the smokable material, wherein the cooling segment is a hollow tube defining an air gap within the cooling segment, wherein the cooling segment is adjacent to the body of the smokable material, and wherein the cooling segment is configured to provide a temperature differential of at least 40° C. between a heated volatilized component at a first end of the cooling segment and the heated volatilized component at the second end of the cooling segment, wherein the cooling segment is made of paper, wherein a ventilation region is provided in the hollow tube to enable air to pass into the cooling segment, wherein the ventilation region comprises one or more rows of holes formed through the wall of the hollow tube, wherein a ratio of the air to the sum of the heated volatilized components and the air is at least 15%; and a mouth end segment for being received in a mouth of a user;

wherein the ventilation region is at least 11 mm from a proximal end of the mouth end segment wherein the cooling segment of the smoking article is partially inserted into the heating apparatus when the smoking article is fully inserted into the heating apparatus and wherein there is a portion of the cooling segment that extends out of the heating apparatus when the smoking article is fully inserted into the heating apparatus; and wherein the ventilation holes are located in the portion of the cooling segment that extends out of the heating apparatus.

2. The smoking article according to claim 1, wherein the cooling segment comprises a spirally wound paper tube.

3. The smoking article according to claim 1, wherein the cooling segment is configured to provide a temperature differential of at least 60 degrees Celsius between a heated volatilized component entering the first end of the cooling segment and a heated volatilized component exiting the second end of the cooling segment.

4. The smoking article according to claim 1, wherein the mouth end segment is between 6 mm to 10 mm in length.

5. The smoking article according to claim 1, wherein the filter segment comprises a mono-acetate material and is of a length between 6 mm to 10 mm.

6. The smoking article according to claim 1, wherein a length of the assembly is between 37 mm and 45 mm.

7. The smoking article according to claim 1, wherein the body of smokable material is between 34 mm and 50 mm in length.

8. The smoking article according to claim 1, wherein each of the one or more rows of holes is arranged circumferentially around the wall of the hollow tube.

9. The smoking article according to claim 1, wherein the ventilation region comprises a plurality of the rows of holes formed through the wall of the hollow tube, and wherein the rows of holes are axially spaced apart from one another along the ventilation region.

10. The smoking article according to claim 1, wherein at least one of the holes has a diameter of between 100 μm to 500 μm.

11. A system comprising:

a heating apparatus arranged to heat smokable material of a smoking article to volatilize at least one component of the smokable material, the heating apparatus comprising:

a housing having a first opening at a first end through which the smoking article can be inserted into the heating apparatus, and at least one heater arrangement arranged within the housing for heating the smokable material of the smoking article when in use; and a smoking article for insertion into the heating apparatus, the smoking article comprising:

a body of smokable material; and an assembly comprising:

a cooling segment for cooling the volatilized at least one component of the smokable material, wherein the cooling segment is a hollow tube defining an air gap, wherein the cooling segment is adjacent to the body of smokable material and wherein the cooling segment is configured to provide a temperature differential of at least 40° C. between a heated volatilized component at a first end of the cooling segment and the heated volatilized component exiting at a second end of the cooling segment, wherein the cooling segment is made of paper; wherein a ventilation region is provided in the hollow tube to enable air to pass into the cooling segment, wherein the ventilation region comprises one or more rows of holes formed through the wall of the hollow tube, wherein a ratio of the air to the sum of the heated volatilized components and the air is at least 15%; and a mouth end segment for being received in a mouth of a user; wherein the ventilation region is at least 11 mm from a proximal end of the mouth end segment wherein the cooling segment of the smoking article is partially inserted into the heating apparatus when the smoking article is fully inserted into the heating apparatus and wherein there is a portion of the cooling segment that extends out of the heating apparatus when the smoking article is fully inserted into the heating apparatus; and wherein the ventilation holes are located in the portion of the cooling segment that extends out of the heating apparatus.

12. A smoking article according to claim 1, wherein said assembly comprises a filter segment adjacent to the cooling segment for filtering the volatilized at least one component of the smokable material.

* * * * *